US008870107B2

(12) United States Patent
Smith

(10) Patent No.: US 8,870,107 B2
(45) **Date of Patent: *Oct. 28, 2014**

(54) MULTI-FUNCTIONAL TOOL ASSEMBLY FOR PROCESSING TOOL OF MATERIAL PROCESSING MACHINE

(71) Applicant: Smoracy, LLC, Remus, MI (US)

(72) Inventor: Leward Nile Smith, Lake City, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/854,113

(22) Filed: Mar. 31, 2013

(65) Prior Publication Data

US 2013/0277480 A1 Oct. 24, 2013

Related U.S. Application Data

(63) Continuation of application No. 12/760,505, filed on Apr. 14, 2010, now abandoned, which is a continuation-in-part of application No. 11/702,452, filed on Feb. 5, 2007, now Pat. No. 7,726,594, which is a continuation-in-part of application No. 11/416,806, filed on May 3, 2006, now Pat. No. 7,384,011, which is a continuation-in-part of application No. 11/042,590, filed on Jan. 25, 2005, now Pat. No. 7,121,485, which is a continuation of application No. 09/970,060, filed on Oct. 3, 2001, now Pat. No. 6,845,931.

(51) Int. Cl.

| | |
|---|---|
| ***B02C 13/288*** | (2006.01) |
| ***B02C 18/14*** | (2006.01) |
| ***B02C 18/18*** | (2006.01) |
| ***B02C 13/28*** | (2006.01) |
| ***B02C 13/06*** | (2006.01) |

(52) U.S. Cl.

CPC ..... *B02C 13/2804* (2013.01); *B02C 18/145* (2013.01); *B02C 13/288* (2013.01); *B02C 18/184* (2013.01); *B02C 13/28* (2013.01); *B02C 13/06* (2013.01)

USPC ..... 241/55; 241/294

(58) Field of Classification Search

USPC ..... 241/55, 294

See application file for complete search history.

(56) References Cited

U.S. PATENT DOCUMENTS

| | | | | |
|---|---|---|---|---|
| 5,100,070 | A * | 3/1992 | Montgomery, Sr. | 241/294 |
| 5,957,176 | A * | 9/1999 | Stein | 144/230 |
| 6,845,931 | B1 * | 1/2005 | Smith | 241/55 |
| 7,121,485 | B2 * | 10/2006 | Smith | 241/55 |
| 7,384,011 | B1 * | 6/2008 | Smith | 241/55 |
| 7,726,594 | B2 * | 6/2010 | Smith | 241/55 |

FOREIGN PATENT DOCUMENTS

| | | |
|---|---|---|
| WO | WO2007096155 | 8/2007 |

* cited by examiner

*Primary Examiner* — Mark Rosenbaum

(74) *Attorney, Agent, or Firm* — Paparella & Associates, PC; Joseph A. Paparella

(57) ABSTRACT

A multi-functional tool assembly for a material processing machine includes a material reducer adapted to reduce material within the material processing machine, and a single tool to support said material reducer. The tool includes a head, a shaft, and a locking feature integrally formed therein.

13 Claims, 8 Drawing Sheets

FIG 3
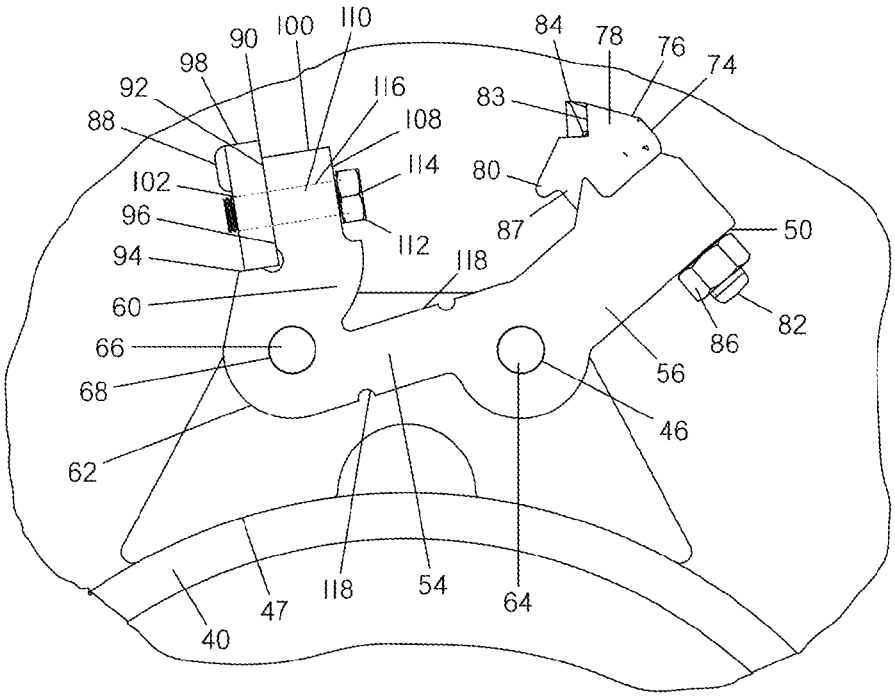
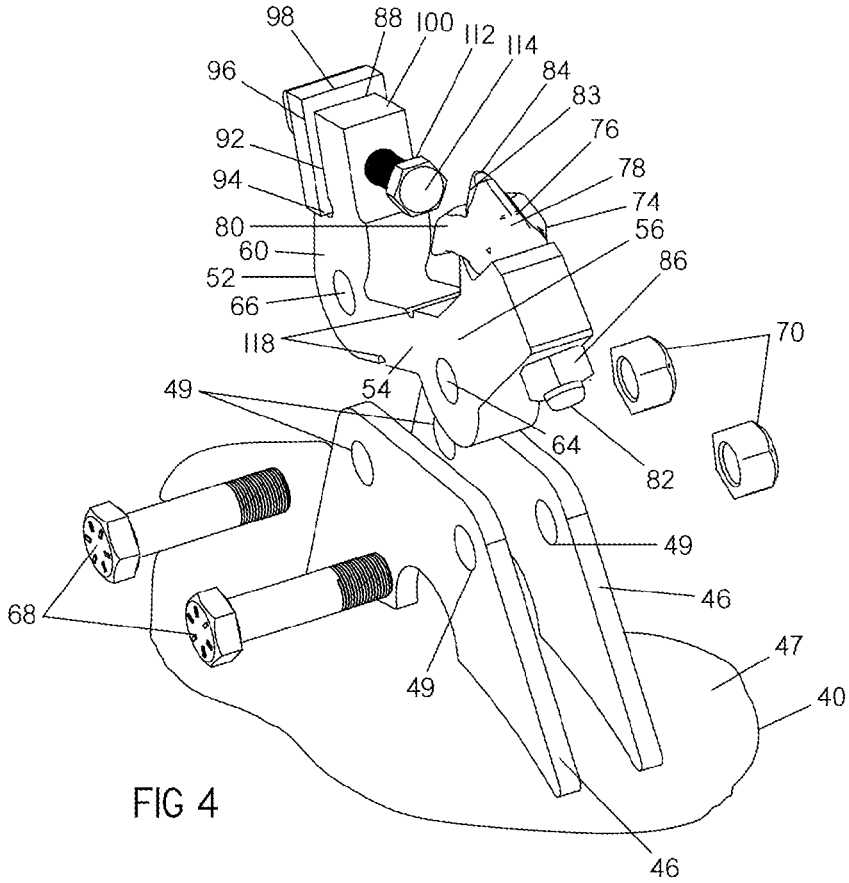
FIG 4

FIG 7
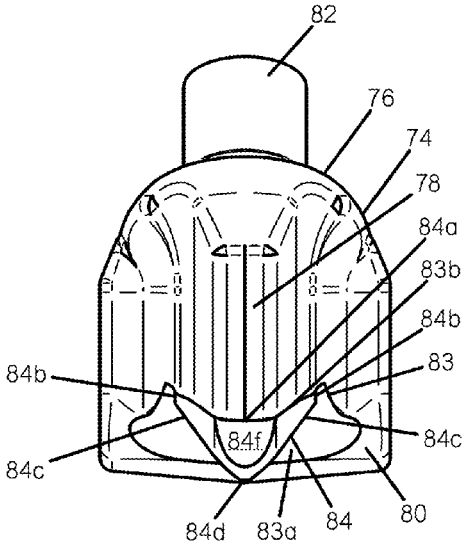
FIG 6
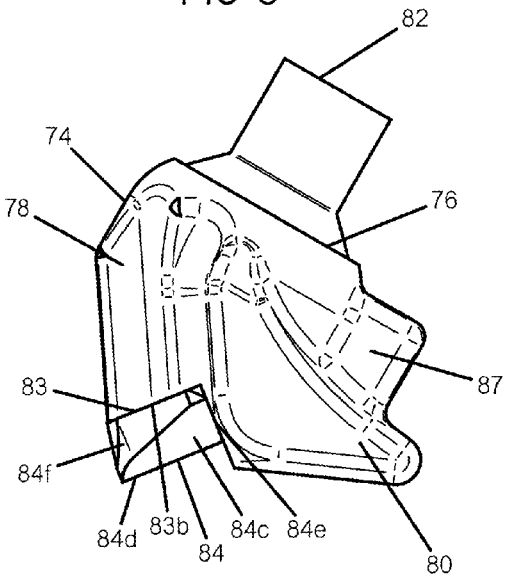
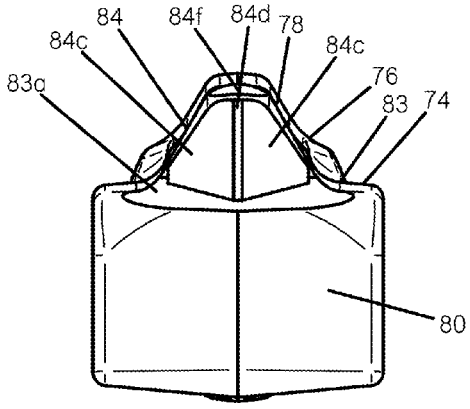
FIG 5

FIG 10
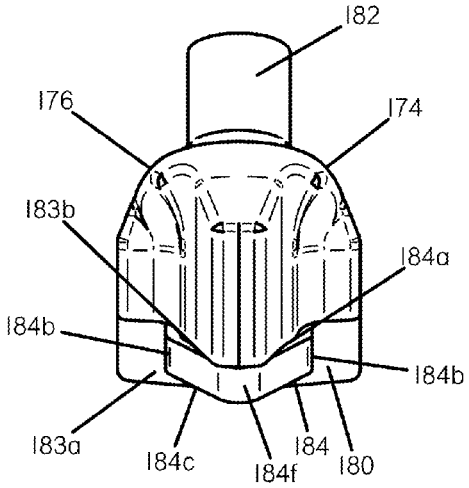
FIG 9
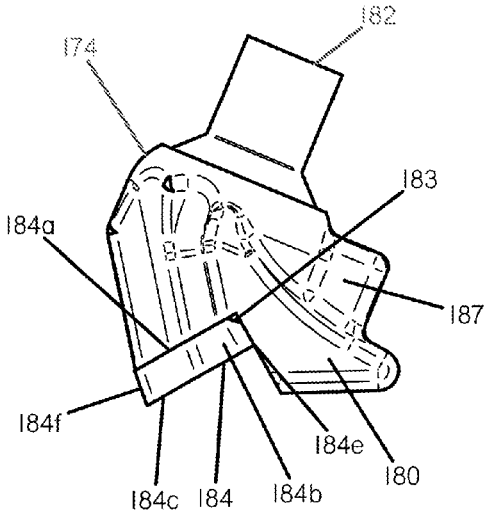
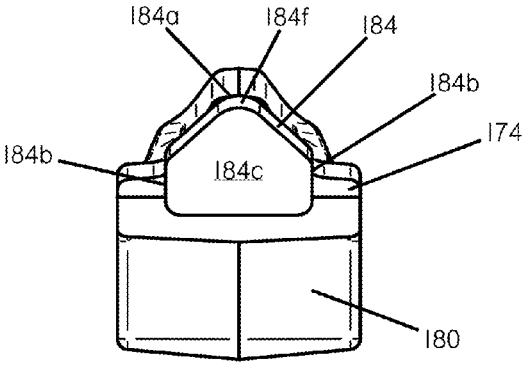
FIG 8

MULTI-FUNCTIONAL TOOL ASSEMBLY FOR PROCESSING TOOL OF MATERIAL PROCESSING MACHINE

CROSS REFERENCE TO RELATED APPLICATIONS

The present application is a continuation of U.S. patent application Ser. No. 12/760,505, filed Apr. 14, 2010, which is a continuation-in-part of U.S. patent application Ser. No. 11/702,452, filed Feb. 5, 2007, now U.S. Pat. No. 7,726,594, which is a continuation-in-part of U.S. patent application Ser. No. 11/416,806, filed May 3, 2006, now U.S. Pat. No. 7,384,011, which is a continuation-in-part of U.S. patent application Ser. No. 11/042,590, filed Jan. 25, 2005, now U.S. Pat. No. 7,121,485, which is a continuation of U.S. patent application Ser. No. 09/970,060, filed Oct. 3, 2001, now U.S. Pat. No. 6,845,931, the complete subject matter each of which are hereby incorporated herein by reference, in their entirety.

BACKGROUND OF THE INVENTION

The present invention relates generally to material processing machines and, more particularly, to a multi-functional tool assembly for a processing tool of a material processing machine.

It is known to provide material processing machines to reduce waste materials. For such a waste processing machine, the machine typically includes a rotor assembly for reducing the waste material as the rotor assembly rotates. An example of such a rotor assembly for a waste processing machine is disclosed in U.S. Pat. No. 5,863,003, issued Jan. 26, 1999, to Smith, entitled "WASTE PROCESSING MACHINE". In that patent, the rotor assembly includes a rotor having a plurality of spaced pairs of mounting arms. The rotor assembly also includes a processing tool mounted to each pair of mounting arms. An example of a processing tool is disclosed in U.S. Pat. No. 6,845,931, issued Jan. 25, 2005, to Smith, entitled "MULTI-FUNCTIONAL TOOL ASSEMBLY FOR PROCESSING TOOL OF A WASTE PROCESSING MACHINE". In that patent, the processing tool includes a tool holder attached to the mounting arms of the rotor assembly by fasteners. The tool holder has a pair of spaced arms extending radially with a tool for reducing waste product attached to one arm and a wear bar or raker for depth limiting guiding attached to the other arm. Typically, the tool is of a single cutting, bullet, or fan type having a head attached to a shaft by suitable means such as brazing. The shaft of the tool is extended through an aperture in the arm of the processing tool and secured thereto by a fastener such as a nut. The complete subject matter of these patents are hereby incorporated herein by reference, in their entirety.

Typically, the tool of the cutting type is used for cutting waste material and provides aggressive intake of waste material, but poor output of reduced waste material. The tool of the bullet type is used for splitting waste material to reduce it without cutting and provides aggressive intake of waste material, but provides poor output of reduced waste material. The tool of the fan type is used for impacting waste material such as grass and leaves to reduce it without cutting and provides poor intake of waste material, but provides aggressive output of reduced waste material.

An example of the above tools are disclosed in U.S. Pat. No. 6,059,210, issued May 9, 2000, to Smith, entitled "ROTOR ASSEMBLY FOR A WASTE PROCESSING MACHINE". In that patent, the rotor assembly includes a rotor and a plurality of processing tools mounted to the rotor.

The processing tools include a combination of at least two different types of tools to provide aggressive intake of waste material and aggressive output of reduced waste material in the waste processing machine. The complete subject matter of this patent is hereby incorporated herein by reference, in its entirety.

Therefore, it is desirable to provide a multi-functional tool for a waste processing machine that will aggressively reduce waste material and aggressively output reduced waste material. It is also desirable to provide a single multi-functional tool and single multi-functional tool assembly in a waste processing machine for reducing waste material and aggressively outputting the reduced waste material. It is further desirable to provide a multi-functional tool and assembly which is keyed for proper orientation and prevents rotation of the multi-functional tool and assembly. It is further desirable to provide a multi-functional tool which is unitary and thereby reduces manufacturing costs of the multi-functional tool and assembly. It is still further desirable to provide a multi-functional tool and assembly that reduces disproportionate wear and maintains acceptable product life.

Accordingly, a need exists for novel systems which have, among other advantages, the ability to provide a single multi-functional tool assembly in a material processing machine for reducing material and aggressively outputting the reduced material. It is also desirable to provide a multi-functional tool assembly for a material processing machine that reduces or eliminates the material reducer from disengaging the processing tool when reducing material. It is still further desirable to provide a multi-functional tool assembly that reduces or redirects the shear force vector acting on the material reducer. It is further desirable to provide a multi-functional tool and assembly which is keyed for proper orientation thereby preventing rotation of the multi-functional tool and assembly. It is yet further desirable to provide a multi-functional tool which is unitary and thereby reduces manufacturing costs of the multi-functional tool and assembly. Therefore, a multi-functional tool and assembly that solves the aforementioned disadvantages and having the aforementioned advantages is desired.

SUMMARY OF THE PRESENT INVENTION

The aforementioned drawbacks and disadvantages of these former waste processing machines have been identified and a solution is set forth herein by the inventive multi-functional tool and assembly which includes, a multi-functional tool assembly for a material processing machine and includes a material reducer adapted to reduce material within the material processing machine and a single tool to support the material reducer, wherein the tool includes a head, a shaft, and a locking feature integrally formed therein.

Another aspect of the present invention includes a processing tool for a material processing machine comprising a tool holder for attachment to a rotor assembly of the material processing machine, and a multi-functional tool which is adapted to be supported by the tool holder to reduce the material. The multi-functional tool includes a head and a locking feature to orient and prevent rotation of the multi-functional tool within the tool holder. Further, a material reducer is attached to the head.

In another aspect of the present invention, a unitary multi-functional tool for a material processing machine includes a shaft, a head operatively supported by the shaft, a material reducer operatively supported by the head to reduce material, and a tab operatively supported by the head to orient and prevent rotation of the multi-functional tool.

And still in another aspect of the present invention, a multi-functional tool assembly for a material processing machine comprises a tool including a head, a shaft, a fan, and a tab, which all may be integrally formed together. Additionally, a material reducer is adapted to reduce material within the material processing machine, the material reducer being disposed on the head. Further, the fan may be disposed below the material reducer and the tab may be disposed below the fan.

One advantage of the present invention is that a multi-functional tool assembly is provided for a processing tool of a material processing machine. Another advantage of the present invention is that the multi-functional tool assembly is a single multi-functional tool that allows material to be reduced and aggressively outputs the reduced material from the rotor assembly in the material processing machine. Yet another advantage of the present invention is that the multi-functional tool assembly is that the multi-functional tool is keyed for proper orientation and prevents rotation of the multi-functional tool and assembly. Another advantage is that the multi-functional tool is unitary thereby reducing manufacturing costs. Still another advantage of the present invention is that the multi-functional tool assembly prevents disproportionate wear and maintains acceptable product life.

Other objects, advantages, and features of the invention will become apparent upon consideration of the following detailed description and drawings. As such, the above brief descriptions set forth, rather broadly, the more important features of the present novel invention so that the detailed descriptions that follow may be better understood and so that the contributions to the art may be better appreciated. There are of course additional features that will be described hereinafter which will form the subject matter of the claims.

As such, those skilled in the art will appreciate that the conception upon which this disclosure is based may readily be used as a basis for designing other structures, methods, and systems for carrying out the several purposes of the present invention. It is important therefore that the claims are regarded as including such equivalent constructions, as far as they do not depart from the spirit and scope of the present invention.

Further, the purpose of the Abstract is to enable the United States Patent and Trademark Office, the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any manner.

These and other objects, along with the various features and structures that characterize the invention, are pointed out with particularity in the claims annexed to and forming a part of this disclosure. For a better understanding of the multi-functional tool and assembly of the present disclosure, its advantages, and the specific traits attained by its use, reference should be made to the accompanying drawings and other descriptive matter in which there are illustrated and described the preferred embodiments of the invention.

As such, while embodiments of the multi-functional tool and assembly are herein illustrated and described, it is to be appreciated that various changes, rearrangements, and modifications may be made therein without departing from the scope of the invention as defined by the claims.

BRIEF DESCRIPTION OF THE DRAWINGS

As a compliment to the description and for better understanding of the specification presented herein, 8 pages of drawings are disclosed with an informative, but not limiting, intention.

FIG. 3 is a fragmentary side view of a processing tool, according to one embodiment of the present invention, of the rotor assembly of FIG. 2;

FIG. 4 is an exploded perspective view of the processing tool of FIG. 3;

FIG. 5 is a front view of a multi-functional tool assembly, according to one embodiment of the present invention, of the processing tool of FIG. 4;

FIG. 6 is a fragmentary side view of the multi-functional tool assembly of FIG. 5;

FIG. 7 is a fragmentary plan view of the multi-functional tool assembly of FIG. 5;

FIG. 8 is a front view of another embodiment, according to one embodiment of the present invention, of a multi-functional tool assembly;

FIG. 9 is a fragmentary side view of the multi-functional tool assembly of FIG. 8;

FIG. 10 is a fragmentary plan view of the multi-functional tool assembly of FIG. 8;

DETAILED DESCRIPTION OF THE PREFERRED EMBODIMENT

The best mode for carrying out the invention is presented in terms of the preferred embodiment, wherein similar referenced characters designate corresponding features throughout the several figures of the drawings.

Figure 1:
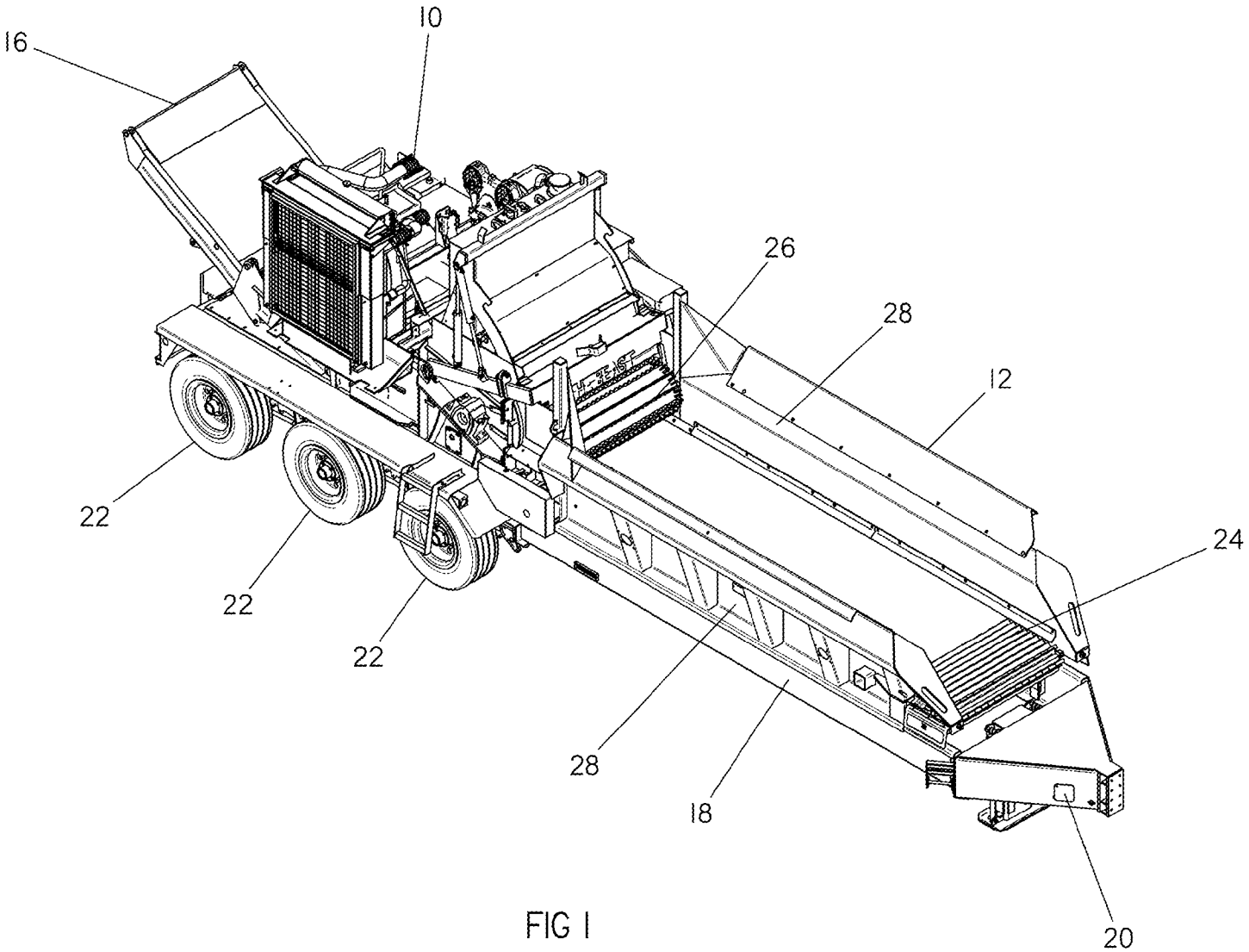
FIG. 1 is a front perspective view of a material processing machine.

For purposes of description herein, the terms "upper", "lower", "right", "left", "rear", "front", "vertical", "horizontal", and derivatives thereof, shall relate to the invention as oriented in FIG. 1. However, it is to be understood that the invention may assume various alternative orientations, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Reference will now be made in detail to the present preferred embodiments of the invention, examples of which are illustrated in the accompanying drawings. Wherever possible, these same referenced numerals will be used throughout the drawings to refer to the same or like parts. Like features between the various embodiments utilize similar numerical designations. Further, the dimensions illustrated in the drawings (if provided) are included for purposes of example only and are not intended to limit the scope of the present invention. Additionally, particular details in the drawings which are illustrated in hidden or dashed lines are to be considered as forming no part of the present invention.

As used herein, the terms wood and wood products are meant to be used and defined in their broad, general, and ordinary sense, and the terminology is meant to include trees, brush, trunks, stems, branches, leaves, or the like, or anything else that could otherwise be recycled, reduced, or otherwise processed; and further includes non-naturally occurring or manufactured wood products such as lumber, pallets, or other manufactured products that could otherwise be recycled, reduced, or otherwise processed, as is generally known within the art.

As used herein, the term material processing system is meant to be used and defined in its general and ordinary sense. To wit, systems that recycle, reduce, or otherwise process wood products. Included therein are machines that chip, cut, grind, or otherwise reduce wood waste products and include, generally, chippers and/or shredders. Of course, this is not meant to be limiting in any manner and these systems may take on numerous configurations, and may be used for numerous purposes as is generally known within the art.

Referring now to the drawings and in particular to FIG. 1, one embodiment of a material processing machine 10 for reducing material is shown. The material processing machine 10 includes an infeed system 12, a material reducing system 14, and a discharge system 16. Material enters the material processing machine 10 through the infeed system 12 where it is directed to the material reducing system 14. The material reducing system 14 reduces the material and directs it to the discharge system 16 where the reduced material is expelled from the material processing machine 10. The material processing machine 10 may be supported on a trailer framework 18 having a tongue mount 20 provided at a front thereof and wheels 22 near a rear of the framework 18. It should be appreciated that, with this structure, the infeed system 12 and material reducing system 14 can be transported together while the discharge system 16 can be transported separately therefrom. It should also be appreciated that the material may take many forms and varieties such as wood, wood products, waste, boards, roots, brush, etc. and processed into different types such as waste, sawdust, wood chips, etc.

Figure 2:
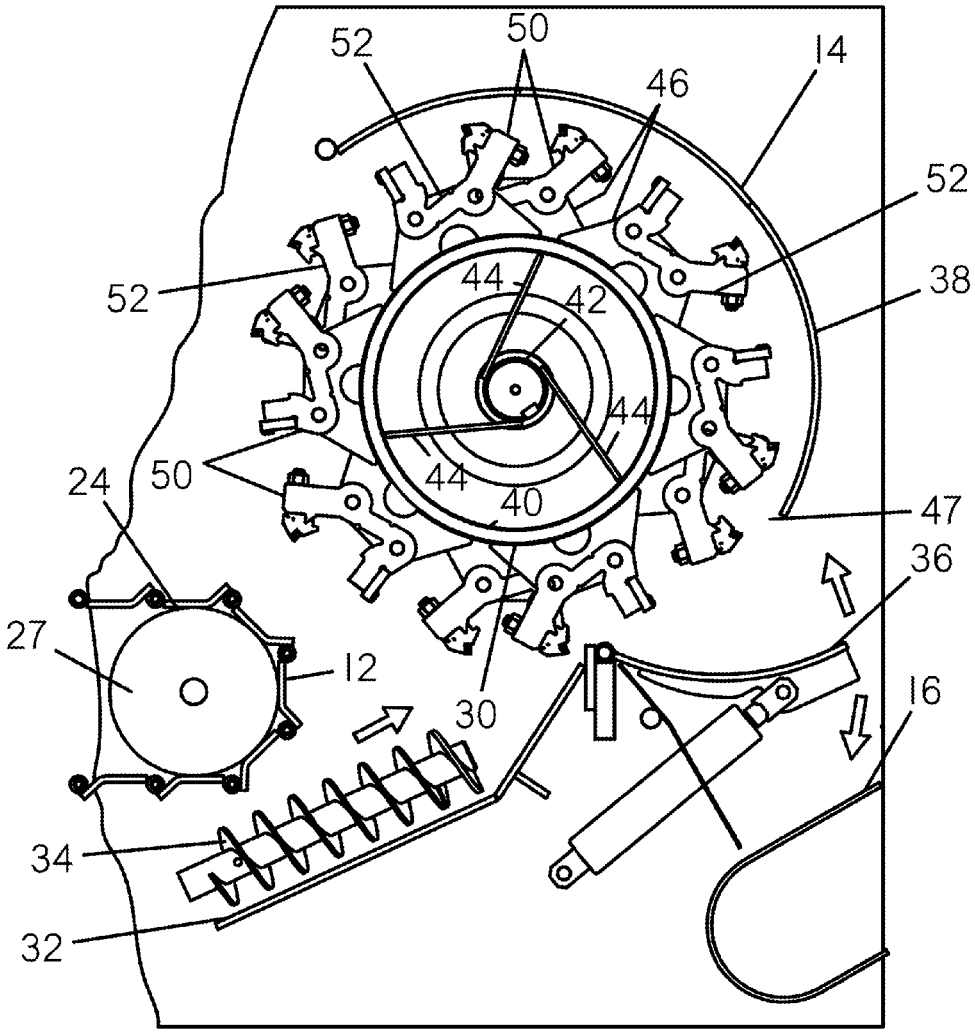
FIG. 2 is a fragmentary sectional view of a rotor assembly of the material processing machine of FIG. 1.
Figure 11:
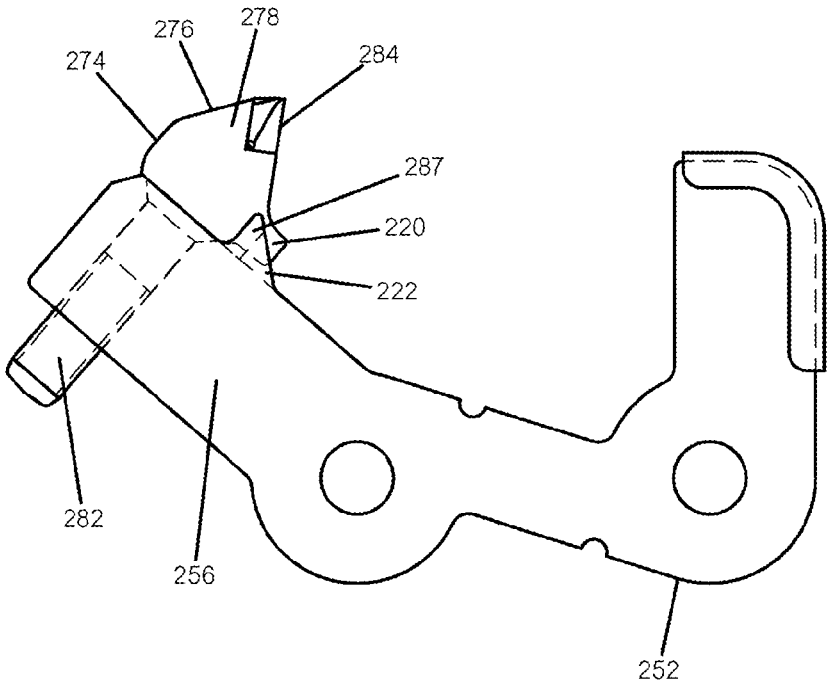
FIG. 11 is a side view of a processing tool, according to another embodiment of the present invention.
Figure 14:
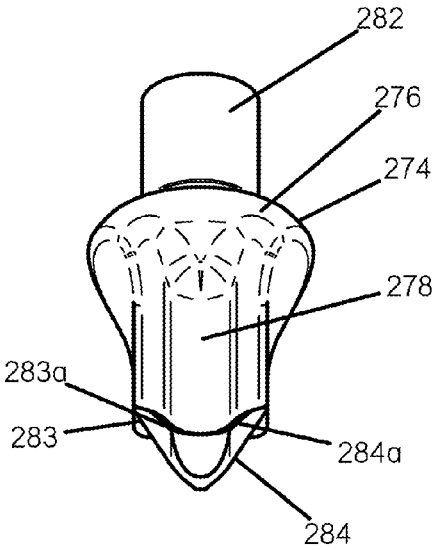
FIG. 14 is a fragmentary plan view of the multi-functional tool assembly of FIG. 12.
Figure 13:
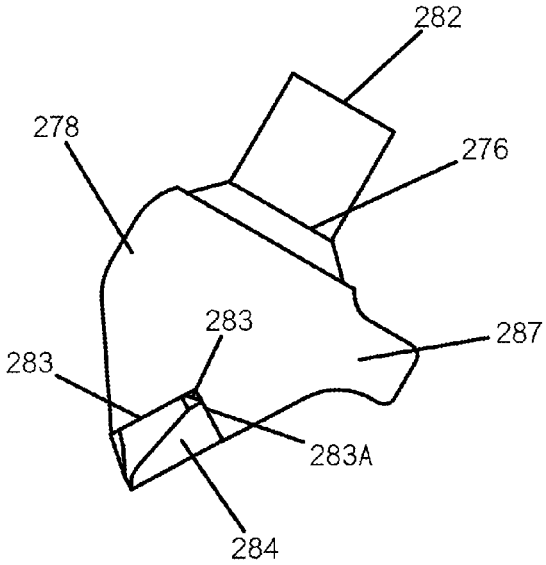
FIG. 13 is a fragmentary side view of the multi-functional tool assembly of FIG. 12.
Figure 12:
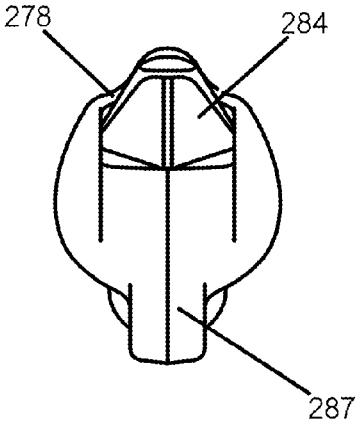
FIG. 12 is a front view of a multi-functional tool assembly, according to one embodiment of the present invention, of the processing tool of FIG. 11.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 30 to be described of the material reducing system 14. The infeed conveyor 24 is the sole means of support for the material and acts as a primary anvil for reducing the material by the rotor assembly 30 to be described. Opposed side walls 28 are provided on opposite sides of the infeed conveyor 24 to contain the material. It should be appreciated that material is placed on the infeed conveyor 24, which moves the material into contact with the feed wheel assembly 26, which, in turn, rotates and feeds the material into contact with the rotor assembly 30 of the material reducing system 14.

Referring to FIGS. 2 and 3, the material reducing system 14 includes a rotor assembly, according to the present invention and generally indicated at 30. The material reducing system 14 also includes a housing 32 disposed about the rotor assembly 30 and a plurality of regrind augers 34 positioned at a bottom of the housing 32. The material reducing system 14 further includes a movable concave screen 36 and a fixed concave screen 38 at a rear of the housing 32. It should be appreciated that the material reducing system 14 reduces material by the rotor assembly 30, which passes through the screens 36 and 38 to the discharge system 16. It should also be appreciated that the regrind augers 34 move reduced material or product into contact with the rotor assembly 30 for further reduction to pass through the screens 36 and 38.

The rotor assembly 30 also includes a rotatable rotor 40 disposed within the housing 32 above the regrind augers 34. The rotor 40 is a generally cylindrical tube having a longitudinal axis. The rotor 40 is mounted to a coaxially disposed shaft 42 by multiple braces 44 extending tangentially from an outer surface of the shaft 42 to an inner surface 45 of the rotor 40. Preferably, each brace 44 is an elongated plate-like member fixed tangentially to the shaft 42 by suitable means such as welding and is similarly secured to the inner surface 45 of the rotor 40 by suitable means such as welding. It should be appreciated that a power source (not shown) is connected to the shaft 42 in a well-known manner and is adapted to turn the shaft 42 and rotor 40.

Referring to FIGS. 2 through 4, the rotor assembly 30 also includes a plurality of spaced pairs of mounting arms 46 mounted to an outer surface 47 of the rotor 40 by suitable means such as welding. Each mounting arm 46 is generally trapezoidal in shape and includes at least one, preferably a pair of spaced apertures 49 extending therethrough. The mounting arms 46 are wrapped about the rotor 40 in a first spiral and a second spiral spaced or offset from the first spiral. The rotor assembly 30 further includes a plurality of processing tools, according to the present invention and generally indicated at 50, mounted to the mounting arms 46. The first spiral and the second spiral of mounting arms 46 extend about the rotor 40 so that in one rotation of the rotor assembly 30, every point on an imaginary axial line segment positioned adjacent to the rotor assembly 30 will be contacted by the processing tools 50 mounted to the rotor assembly 30.

Each of the processing tools 50, according to the present invention, includes a tool holder 52 having a general "C" shape. The tool holder 52 has a body 54 extending circumferentially and a first or trailing arm 56 extending radially at an angle therefrom with a first aperture 58 extending therethrough. The tool holder 52 also includes a second or leading arm 60 extending radially at an angle from the body 54. The tool holder 52 includes an aperture 64 and 66 at a lower radial end of the first arm 56 and second arm 60, respectively, and extending axially therethrough. The body 54 has a width or thickness less than the first arm 56 and the second arm 60. The tool holder 52 is continuous, integral, unitary, and made as one-piece. It should be appreciated that the apertures 64,66 of the tool holder 52 are aligned with the apertures 49 of the mounting arms 46.

The rotor assembly 30 includes at least one, preferably a pair of fasteners such as bolts 68 and nuts 70 for retaining the processing tools 50 to the mounting arms 46. The bolts 68 extend through the apertures 49 in the mounting arms 46 and the apertures 64,66 of the tool holder 52 and threadably engage the nuts 70. It should be appreciated that the tool holder 52 is disposed between the mounting arms 46.

Referring to FIGS. 2 through 7, the processing tool 50 also includes a multi-functional tool assembly, generally indicated at 74 and according to the present invention, attached to the tool holder 52. The multi-functional tool assembly 74 includes a multi-functional tool 76 to aggressively intake the material, reduce the material, and aggressively output the reduced material by pushing the reduced material to the screens 36, 38 and out of the rotor assembly 30.

The multi-functional tool 76 includes a head 78, fan 80, and shaft 82. The head 78, fan 80, and shaft 82 are made of a metal material and are preferably made as a single forging. The head 78, fan 80, and shaft 82 are preferably a monolithic structure being integral, unitary, and one-piece.

The multi-functional tool 76 also includes a cavity or pocket, generally indicated at 83, between the head 78 and the fan 80 to receive a material reducer 84 to be described. The cavity 83 includes a base wall 83*a*, which is generally planar, and extends laterally and longitudinally. The cavity 83 also includes a side wall 83*b*, which is generally arcuate in shape such as concave, and extending vertically or generally perpendicular to the base wall 83*a*. It should be appreciated that the cavity 83 is formed by a mill (not shown) that plunges into the forging in a secondary machining operation to machine the cavity 83 therein.

The multi-functional tool assembly 74 also includes a material reducer, generally indicated at 84, disposed in the cavity 83. In the embodiment illustrated, the material reducer 84 is a splitter to split or reduce the material. The material reducer 84 has a rear surface 84*a* that is generally arcuate in shape such as convex and extending laterally. The material reducer 84 also has a pair of opposed side surfaces 84*b* extending longitudinally from the rear surface 84*a*. The material reducer 84 further has a pair of front surfaces 84*c* extending longitudinally and inwardly toward each other at an angle such as thirty-two degrees (32 degrees) to a planer tip surface 84*d*. The planar tip surface 84*d* extends axially or vertically and inwardly at an angle such as two degrees (2 degrees). The material reducer 84 also has a generally planar bottom surface 84*e* and an arcuate or convex top surface 84*f*. The material reducer 84 is disposed in the cavity 83 such that the rear surface 84*a* contacts the side wall 83*b* and the bottom surface 84*e* contacts the base wall 83*a*. The material reducer 84 has a lateral width less than a lateral width of the side wall 83*b* of the cavity 83. The material reducer 84 is attached to the head 78 by suitable means such as brazing. The material reducer 84 is made of a carbide material. It should be appreciated that, in other embodiments, the material reducer 84 is a cutter to cut and reduce the material.

Referring to FIGS. 3 through 7, the fan 80 is disposed radially below the material reducer 84. The fan 80, in one embodiment, is generally rectangular in shape. The fan 80 has a width greater than the height thereof. Preferably, the fan 80 is disposed radially one half inch back or inward from an outer periphery of the material reducer 84 to provide one inch of clearance between the fan 80 and an inner surface of the housing 32 of the rotor assembly 30.

The shaft 82 is disposed opposite the fan 80 and extends outwardly therefrom. The shaft 82 extends axially through the aperture 58 in the first arm 56 and is removably secured to the first arm 56 by a suitable mechanism such as a nut 86 threadably engaging the shaft 82. It should be appreciated that the fan 80 is not a cutting tooth and does not reduce the material, but aggressively outputs the reduced material. It should also be appreciated that the material reducers 84 are typically one inch apart axially and the fans 80 are typically two inches wide axially to cover a space between the material reducers 84. It should further be appreciated that the fan 80 may have any suitable shape or area to push reduced material for aggressive output thereof. It should still further be appreciated that the aggressive output of the fan 80 assists in reducing wear to other components of the rotor assembly 30.

The multi-functional tool 76 includes a tab 87 extending from the head 78 and behind the fan 80. The tab 87 is generally rectangular in shape. The tab 87 has a width less than a width of the head 78. The tool holder 52 may include a slot (not shown) in the first arm 56 to receive the tab 87 to orientate the multi-functional tool 76 and prevent rotation of the multi-functional tool 76 by locking it in place. In another embodiment, the tool holder 52 may include a pair of spaced tabs (not shown) extending outwardly from the first arm 56 to receive the tab 87 therebetween to orientate the multi-functional tool 76 and prevent rotation of the multi-functional tool 76 by locking it in place. The head 78, fan 80, shaft 82, and tab 87 are preferably made of a metal material and are made as a single forging. It should be appreciated that the head 78, fan 80, shaft 82, and tab 87 are preferably a monolithic structure being integral, unitary, and one-piece.

Referring back to FIGS. 2 through 4, the processing tool 50 also a raker assembly, generally indicated at 88, attached to the second arm 60. The raker assembly 88 may be fixed or removable from the second arm 60. In the embodiment illustrated, the raker assembly 88 is removable and replaceable. The raker assembly 88 includes a raker 90 disposed in a recess 92 on a forward side of a free end of the second arm 60. The recess 92 is generally rectangular in shape and has a lower surface 94 and a side surface 96. The raker 90 includes a raker wear bar 98 disposed in the recess 92. The raker wear bar 98 is generally rectangular in shape. The raker wear bar 98 is of such a length to extend outwardly beyond a radial end surface 100 of the second arm 60 when disposed in the recess 92. The raker wear bar 98 rests against and is supported by the lower surface 94 and side surface 96. The raker wear bar 98 has an aperture 102 extending axially therein for a function to be described. The raker wear bar 98 is made of a metal material such as a one-piece hard faced material such as Trimay.

The raker assembly 88 also includes another recess 108 on a rear side of a free end of the second arm 60 opposite the recess 92. The recess 108 is generally rectangular in shape. The raker assembly 88 includes an aperture 110 extending from the recess 108 to the recess 92 in the second arm 60. The raker assembly 88 further includes a fastener such as a bolt 112 to removably secure the raker wear bar 98 to the second arm 60. The bolt 112 has a head 114 disposed in the recess 108 and a threaded shaft 116 extending axially from the head 114 and through the aperture 110 in the second arm 60 and threadably engaging the threads of the aperture 102 in the raker wear bar 98. The bolt 112 is of a sufficient length to extend through the second arm 60 and into the raker wear bar 98 in an unobstructed manner without penetrating the front face of the raker wear bar 98. It should be appreciated that the second arm 60 operates as a depth-limiting guide.

The processing tool 50 may include at least one notch 118 in the tool holder 52 to control breakage of the processing tool 50. Preferably, the processing tool 50 includes a first notch 118 in the body 54 adjacent to the first arm 56 between the first arm 56 and second arm 60 on a radial outer side thereof and a second notch 118 in the body 54 adjacent to the second arm 60 between the first arm 56 and second arm 60 on a radial inner side thereof. The notches 118 extend axially across the body 54 of the tool holder 52. The notches 118 are generally arcuate in shape and have a depth of approximately one-quarter inches (0.25 inches). The position, shape, and depth of the notches 118 are varied to control breakage of the tool holder 52 relative to either the first arm 56 or second arm 60 of the tool holder 52.

In operation, the rotor 40 rotates the processing tools 50. The multi-functional tool assembly 74 contacts material or product, such as wood, first approximately three revolutions before the raker wear bar 98 contacts the material or product. The material reducer 84 splits the material to reduce the material and the fan 80 pushes the reduced material toward the screens 36, 38 of the rotor assembly 30. If the material is stuck or lodged by the multi-functional tool assembly 74 in the material processing machine 10, the first arm 56 will concentrate stress on the tool holder 52 in the notch 118 adjacent to the first arm 56 and cause a breakage by propagating a crack from the notch 118 radially across the body 54 of the tool holder 52. As such, the first arm 56 will then pivot about the bolt 68, which acts as a first pivot pin and remains attached to the mounting arms 46 to prevent damage to the rotor assembly 30. In addition, the remainder of the tool holder 52 including the body 54 and second arm 60 will pivot about the other bolt 68, which acts as a second pivot pin and remains attached to the mounting arms 46 to prevent damage to the rotor assembly 30. The tool holder 52 can then be replaced. It should be appreciated that the multi-functional tool assembly 74 aggressively intakes the material, reduces the material, and aggressively outputs the reduced material from the rotor assembly 30.

During operation, if the material reducer 84 becomes worn due to contact with the material, the material reducer 84 may be removed by unsoldering or unbrazing the material reducer 84 from the head 78 of the multi-functional tool 76. The worn material reducer 84 can be discarded and replaced with a new material reducer 84. The material reducer 84 is disposed in the cavity 83 and soldered or brazed to the head 78 of the multi-functional tool 76 to secure the material reducer 84 in place.

During operation, if the raker wear bar 98 becomes worn due to contact with the material, the bolt 112 may be removed by unthreading the threaded shaft 116 from the raker wear bar 98. The worn raker wear bar 98 can be discarded and replaced with a new raker wear bar 98. The bolt 112 is then threaded with the threads of the aperture 102 to secure the raker wear bar 98 in place.

Referring to FIGS. 8 through 10, another embodiment, according to the present invention, of the multi-functional tool assembly 74 is shown. Like parts of the multi-functional tool assembly 174 have like reference numerals increased by one hundred (100). In this embodiment, the multi-functional tool assembly 174 is attached to the tool holder 52. The multi-functional tool assembly 174 includes a multi-functional tool 176 to aggressively intake the material, reduce the material, and aggressively output the reduced material by pushing the reduced material to the screens 36, 38 and out of the rotor assembly 30.

The multi-functional tool 176 includes a head 178, fan 180, and shaft 182. The head 178, fan 180, and shaft 182 are preferably made of a metal material and are preferably made as a single forging. The head 178, fan 180, and shaft 182 are preferably a monolithic structure being integral, unitary, and one-piece.

The multi-functional tool assembly 174 includes a cavity or pocket, generally indicated at 183, between the head 178 and the fan 180 to receive a material reducer 184 to be described. The cavity 183 includes a base wall 183*a*, which is generally planar, and extends laterally and longitudinally. The cavity 183 also includes a side wall 183*b*, which is generally arcuate in shape such as concave, and extending vertically or generally perpendicular to the base wall 183*a*. It should be appreciated that the cavity 183 is formed by a mill (not shown) that plunges into the forging in a secondary machining operation to machine the cavity 183 therein.

The multi-functional tool assembly 174 includes a material reducer, generally indicated at 184, disposed in the cavity 183. The material reducer 184 is a cutter to cut or reduce the material. The material reducer 184 has a rear surface 184*a* that is arcuate in shape such as convex and extending laterally. The material reducer 184 also has a pair of opposed side surfaces 184*b* extending longitudinally from the rear surface 184*a*. The material reducer 184 also has a generally planar front surface 184*c* extending laterally between the side surfaces 184*b*. The material reducer 184 further has a generally planar bottom surface 184*e* and an arcuate or convex top surface 184*f*. The material reducer 184 is disposed in the cavity 183 such that the rear surface 184*a* contacts the side wall 183*b* and the bottom surface 184*e* contacts the base wall 183*a*. The material reducer 184 has a lateral width greater than a lateral width of the side wall 183*b* of the cavity 183. The material reducer 184 is attached to the head 178 by suitable means such as brazing. The material reducer 184 is made of a carbide material.

The multi-functional tool 176 includes a tab 187 extending from the head 178 and behind the fan 180. The tab 187 is generally rectangular in shape. The tab 187 has a width less than a width of the head 178. The tool holder 152 may include a slot (not shown) in the first arm 156 to receive the tab 187 to orientate the multi-functional tool 176 and prevent rotation of the multi-functional tool 176 by locking it in place. In another embodiment, the tool holder 152 may include a pair of spaced tabs (not shown) extending outwardly from the first arm 156 to receive the tab 187 therebetween to orientate the multi-functional tool 176 and prevent rotation of the multi-functional tool 176 by locking it in place. The head 178, fan 180, shaft 182, and tab 187 are preferably made of a metal material and are preferably made as a single forging. It should be appreciated that the head 178, fan 180, shaft 182, and tab 187 preferably are a monolithic structure being integral, unitary, and one-piece.

In operation, the rotor 40 rotates the processing tool 50. The multi-functional tool assembly 174 contacts material or product, such as wood, first approximately three revolutions before the raker wear bar 98 contacts the material or product. The waste reducer 184 cuts the material to reduce the material and the fan 180 pushes the reduced material toward the screens 36, 38 of the rotor assembly 30. It should be appreciated that the multi-functional tool assembly 174 aggressively intakes the material, reduces the material, and aggressively outputs the reduced material from the rotor assembly 30.

During operation, if the material reducer 184 becomes worn due to contact with the material, the material reducer 184 may be removed by unsoldering or unbrazing the material reducer 184 from the head 178 of the multi-functional tool 176. The worn material reducer 184 can be discarded and replaced with a new material reducer 184. The material reducer 184 is disposed in the recess 183 and soldered or brazed to the head 178 of the multi-functional tool 176 to secure the material reducer 184 in place.

Referring to FIGS. 11 through 14, another embodiment, according to the present invention, of the multi-functional tool assembly 74 is shown. Like parts of the multi-functional tool assembly 74 have like reference numerals increased by two hundred (200). In this embodiment, the multi-functional tool assembly 274 is attached to the tool holder 252. The multi-functional tool assembly 274 includes a multi-functional tool 276 to aggressively intake the material, reduce the material, and aggressively output the reduced material by pushing the reduced material to the screens 36, 38 and out of the rotor assembly 30.

The multi-functional tool 276 includes a head 278, shaft 282, and a locking feature 287. The head 278, shaft 282, and locking feature 287 are preferably made of a metal material and, in one embodiment, are made as a single forging. In this embodiment the head 278, shaft 282, and locking feature 287 are preferably a monolithic structure being integral, unitary, and one-piece. In one embodiment, locking feature 287 comprises a tab.

The multi-functional tool assembly 274 includes a cavity or pocket, generally indicated at 283, between the head 278 and the tab 287 to receive a material reducer 284. The cavity 283 includes a base wall 283*a*, which is generally planar, and extends laterally and longitudinally. The cavity 283 also includes a side wall 283*b*. The side wall 283*b* may be generally planar or generally arcuate in shape as the particular requirements dictate.

The multi-functional tool assembly 274 includes a material reducer, generally indicated at 284, disposed in the cavity 283. The material reducer 284 is a cutter to cut or reduce the material. The material reducer 284 has a rear surface 284*a* that is generally the same shape as the side wall 283*b*. The material reducer 284 is disposed in the cavity 283 as described herein above and is attached to the head 278 by any suitable means such as, for example only, brazing. In one embodiment, the material reducer 284 is made of a carbide material.

The multi-functional tool 276 also includes a locking feature 287 which in one embodiment comprises a tab 287. The locking feature 287, when installed into a recess 220 disposed accordingly in tool holder 252 prevents rotation of the multi-functional tool 276. Locking feature 287 extends from the head 278 and, in one embodiment, comprises a shape which is generally rectangular in shape, having a width less than a width of the head 278 for reception in a slot or recess 220 in the first arm 256 of tool holder 252. This configuration thereby properly orients the multi-functional tool 276 and prevents rotation thereof by locking it in place: that is to say, preventing it from rotational movement.

The locking feature 287 may comprise any feature which would properly orient and/or prevent rotation of the multi-functional tool 276. For example, in another embodiment, the tool holder 252 may include a pair of spaced tabs 222 extending outwardly from the first arm 256 to receive the tab 287 therebetween. In this embodiment, the head 278, shaft 282, and tab 287 are preferably made of a metal material and are preferably made as a single forging and monolithic in structure being integral, unitary, and one-piece. In one embodiment the locking feature 287 comprises a generally rectangular tab extending outwardly from head 278, the tab extending outwardly approximately 0.5 inches and being approximately 0.5 inches in length and width.

Proper orientation and prevention of rotational movement of multi-functional tool 276 is accomplished through, in one embodiment, slot 220 being adapted to receive tab 287 and thereby constrain tab 287, and accordingly the multi-functional tool 276, from rotation. This may be accomplished for example through tab 287 and slot 220 comprising a similar geometry with tab 287 being dimensionally smaller is size for reception therein. For example only, if tab 287 comprises a width of 0.5 inches and is generally rectangular in shape, then slot 220 may comprise a generally rectangular shape having inside width of 0.6 inches thereby allowing tab 287 to be received therein and confined by the sidewalls 222 thereof.

Figure 15:
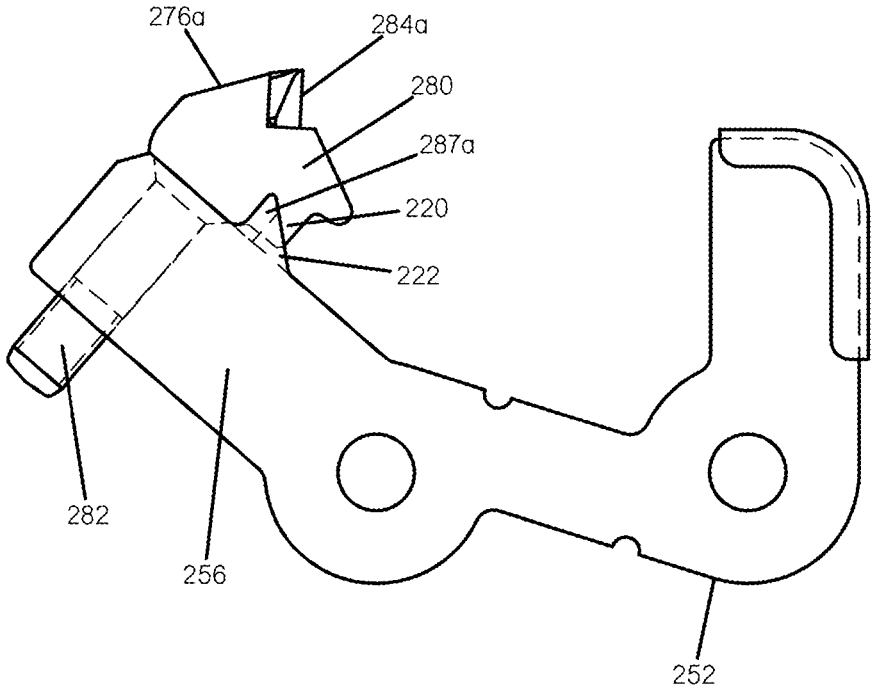
FIG. 15 is a side view of a processing tool, according to yet another embodiment of the present invention.

Referring to FIG. 15, another embodiment, according to the present invention, of the multi-functional tool 276*a* is shown. In this embodiment, the multi-functional tool assembly 274*a* is attached to the tool holder 252. The multi-functional tool assembly 274*a* of this embodiment includes a multi-functional tool 276*a* which further includes a fan 280 as herein described above, the fan 280 being disposed below the material reducer 284 and the tab 287*a* being disposed below the fan 280.

The solutions offered by the invention disclosed herein have thus been attained in an economical, practical, and facile manner. To wit, a novel The multi-functional tool and assembly which is cost effective, easily installed in a proper orientation, is prevented from undesired rotation, and which aggressively puts material has been invented. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to be appreciated that various changes, rearrangements, and modifications may be made therein, without departing from the scope of the invention as defined by the claims.

The invention claimed is:

1. A processing tool for a material processing machine comprising:

a tool holder for attachment to a rotor assembly of the material processing machine;

a multi-functional tool adapted to be supported by said tool holder to reduce material, the multi-functional tool including a head, and a locking feature to orient and prevent rotation of said multi-functional tool within said tool holder; and a material reducer attached to said head;

wherein said multi-functional tool further includes a fan, said fan disposed below said material reducer to aggressively output reduced material from the rotor assembly of the waste processing machine.

2. A processing tool as set forth in claim 1 wherein said head, said fan, said shaft, and said locking feature are integrally formed and comprise a monolithic structure being unitary and one-piece.

3. A processing tool as set forth in claim 1 wherein said tool holder comprises a first arm extending radially and a second arm extending radially and spaced from said first arm.

4. A processing tool as set forth in claim 1 wherein said multi-functional tool is attached to said first arm.

5. A processing tool as set forth in claim 1 including a raker attached to said second arm.

6. A processing tool as set forth in claim 1 wherein said head, said fan, said locking feature, and said shaft are made of a metal material.

7. A processing tool as set forth in claim 1 wherein said head, said fan, said locking feature, and said shaft are made as a single forging.

8. A processing tool as set forth in claim 1 wherein said fan has a width greater than said waste reducer and said locking feature comprises a generally rectangular tab comprising a width less than said waste reducer.

9. A unitary multi-functional tool for a material processing machine comprising:

a shaft;

a head operatively supported by said shaft;

a material reducer operatively supported by said head to reduce material; and a tab operatively supported by said head to orient and prevent rotation of said multi-functional tool.

10. A multi-functional tool as set forth in claim 9 wherein said unitary tool further includes a fan, said fan disposed below said material reducer to aggressively output reduced material from the material processing machine.

11. A multi-functional tool assembly for a material processing machine comprising:

a tool including a head, a shaft, a fan, and a tab;

a material reducer adapted to reduce material within the material processing machine, said material reducer being disposed on said head; and wherein said fan is disposed below said material reducer and said tab is disposed below said fan.

12. A multi-functional tool assembly as set forth in claim 11 wherein said head, said shaft, said fan, and said tab are integrally formed and comprise a monolithic structure being unitary and one-piece.

13. A multi-functional tool assembly as set forth in claim 11 wherein said head includes a cavity having an arcuate surface, and said material reducer is disposed in said cavity and includes an arcuate surface complementary to said arcuate surface of said cavity.

* * * * *